US010433702B2

(12) United States Patent
Esterle et al.

(10) Patent No.: US 10,433,702 B2
(45) Date of Patent: Oct. 8, 2019

(54) DAMPED CLOSURE ASSEMBLY FOR A DISHWASHER APPLIANCE

(71) Applicant: Haier US Appliance Solutions, Inc., Wilmington, DE (US)

(72) Inventors: Christopher D. Esterle, Louisville, KY (US); Mark Weaver, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 247 days.

(21) Appl. No.: 15/652,304

(22) Filed: Jul. 18, 2017

(65) Prior Publication Data

US 2019/0021573 A1 Jan. 24, 2019

(51) Int. Cl.

| | |
|---|---|
| ***A47L 15/42*** | (2006.01) |
| ***A47L 15/50*** | (2006.01) |
| ***A47L 15/22*** | (2006.01) |
| ***A47L 15/46*** | (2006.01) |
| ***E05B 17/00*** | (2006.01) |

(52) U.S. Cl.

CPC ..... *A47L 15/4259* (2013.01); *A47L 15/22* (2013.01); *A47L 15/4293* (2013.01); *A47L 15/46* (2013.01); *A47L 15/502* (2013.01); *A47L 15/507* (2013.01); *E05B 17/0025* (2013.01); *E05B 17/0041* (2013.01)

(58) Field of Classification Search

CPC ..... A47L 15/4259

See application file for complete search history.

(56) References Cited

U.S. PATENT DOCUMENTS

| | | | | |
|---|---|---|---|---|
| 3,410,591 | A * | 11/1968 | Fowler | A47L 15/4259 292/113 |
| 6,290,270 | B1 | 9/2001 | Spiessl | |
| 8,827,388 | B2 | 9/2014 | Johansson et al. | |
| 8,944,535 | B2 | 2/2015 | Becchio et al. | |
| 9,101,259 | B2 | 8/2015 | Dirnberger et al. | |
| 9,107,560 | B2 | 8/2015 | Bauriedl | |
| 2014/0059801 | A1* | 3/2014 | Saito | E05F 1/16 16/72 |

FOREIGN PATENT DOCUMENTS

| | | |
|---|---|---|
| DE | 1020050453651 A1 | 3/2007 |
| KR | 101294777 B1 | 8/2013 |

* cited by examiner

*Primary Examiner* — Jason Y Ko

(74) *Attorney, Agent, or Firm* — Dority & Manning, P.A.

(57) ABSTRACT

A damped closure assembly for a door of a dishwasher appliance includes a striker mounted to the door and a latch assembly mounted to a tub of the dishwasher appliance. The latch assembly includes a latch body that defines a guide slot and a slide member including guide pins that are received within the guide slot to slidably and rotatably position the slide member within the latch body. A spring element is attached to the slide member for urging the slide member toward a retracted position and a damping element is operably coupled to the slide member for damping the movement of the slide member toward the retracted position. The slide member is latched in an extended position when the door is open, but when the door is closed, the striker unlatches the slide member and allows the spring/damper combination to slowly move the door to the closed position.

20 Claims, 8 Drawing Sheets

DAMPED CLOSURE ASSEMBLY FOR A DISHWASHER APPLIANCE

FIELD OF THE INVENTION

The present disclosure relates generally to dishwasher appliances, and more particularly to improved door closure mechanisms for dishwasher appliances.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one pump for circulating fluid through the multiple spray assemblies. In addition, devices referred to as diverters may be used to control the flow of fluid received from the pump.

In order to provide access to the wash chamber and to contain the spray of wash fluid during a wash or rinse cycle, dishwasher appliances further include a door that is typically pivotally mounted to a bottom of the tub. A latch mechanism is typically positioned at a top of the door and is configured for locking the door in the closed position during an operating cycle. Notably, however, such a latch mechanism often engages the door of the dishwasher appliance only after the door has been slammed shut, resulting in a loud noise and potentially causing damage or premature wear to one or more dishwasher components. In addition, the tension exerted by the latch mechanism is often fixed, which can result in excessive or insufficient gasket compression, and which cannot be adjusted over time, e.g., to compensate for the varying resiliency of the gasket over time.

Accordingly, a dishwasher appliance that utilizes an improved latching mechanism would be useful. More specifically, a latching mechanism that can slowly close a door of a dishwasher appliance while ensuring sufficient gasket compression would be particularly beneficial.

BRIEF DESCRIPTION OF THE INVENTION

The present subject matter provides a damped closure assembly for a door of a dishwasher appliance. The damped closure assembly includes a striker mounted to the door and a latch assembly mounted to a tub of the dishwasher appliance. The latch assembly includes a latch body that defines a guide slot and a slide member including guide pins that are received within the guide slot to slidably and rotatably position the slide member within the latch body. A spring element is attached to the slide member for urging the slide member toward a retracted position and a damping element is operably coupled to the slide member for damping the movement of the slide member toward the retracted position. The slide member is latched in an extended position when the door is open, but when the door is closed, the striker unlatches the slide member and allows the spring/damper combination to slowly move the door to the closed position. Additional aspects and advantages of the invention will be set forth in part in the following description, may be apparent from the description, or may be learned through practice of the invention.

In accordance with one exemplary embodiment of the present disclosure, a dishwasher appliance defining a vertical, a lateral, and a transverse direction is provided. The dishwasher appliance includes a cabinet and a tub positioned within the cabinet, the tub defining a wash chamber for receipt of articles for washing. A door is rotatably mounted to the cabinet and is movable between an open position and a closed position. A damped closure assembly includes a striker mounted to the door and a latch body attached to the tub and defining a guide slot. A slide member defines a first guide element and a second guide element that are received within the guide slot for slidably coupling the slide member to the latch body. A spring element is attached to the slide member for urging the slide member toward a retracted position and a damping element is operably coupled to the slide member for damping the movement of the slide member toward the retracted position.

In accordance with another exemplary embodiment of the present disclosure, a damped closure assembly for a door of a dishwasher appliance is provided. The dishwasher appliance includes a cabinet and a tub positioned within the cabinet and defining a wash chamber for receipt of articles for washing. The damped closure assembly includes a striker mounted to the door and a latch body attached to the tub and defining a guide slot. A slide member defines a first guide element and a second guide element that are received within the guide slot for slidably coupling the slide member to the latch body. A spring element is attached to the slide member for urging the slide member toward a retracted position and a damping element is operably coupled to the slide member for damping the movement of the slide member toward the retracted position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
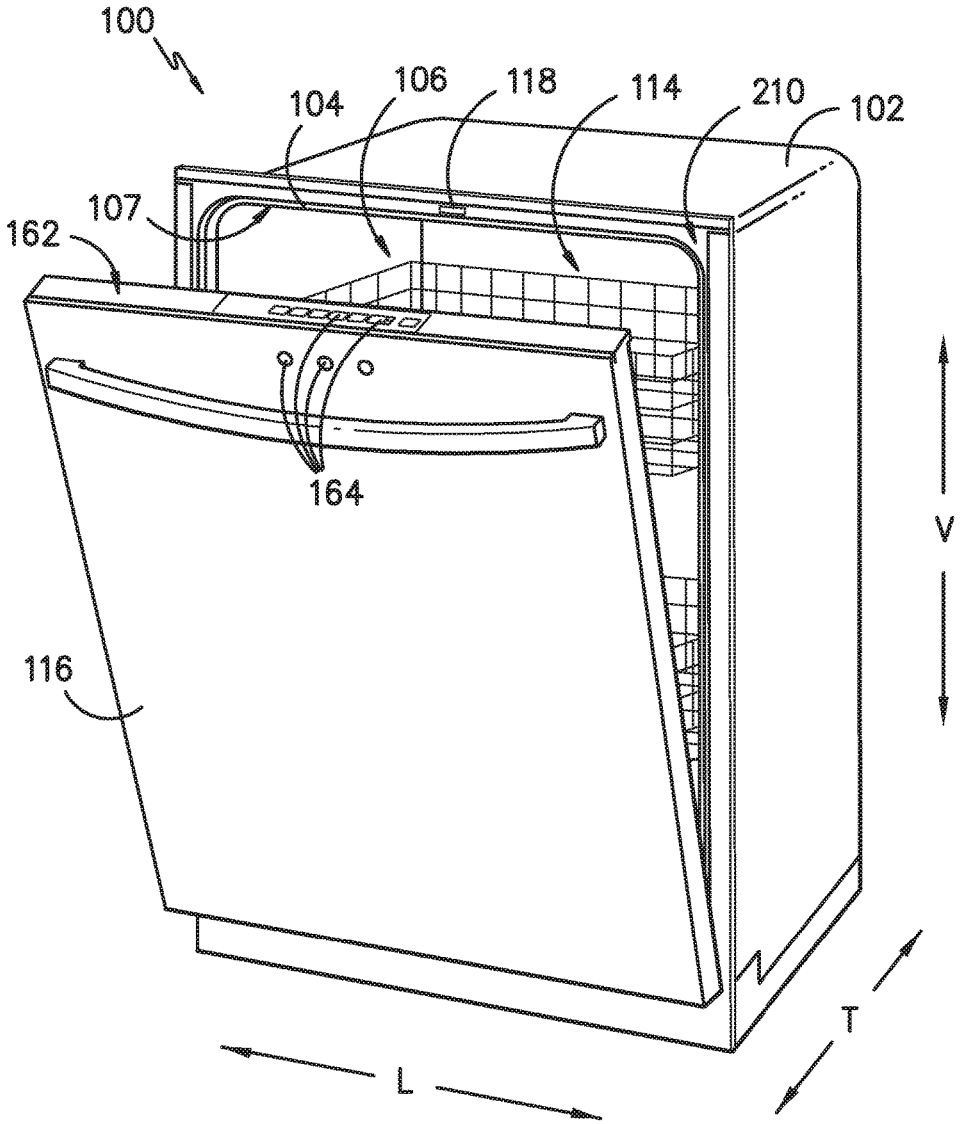
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
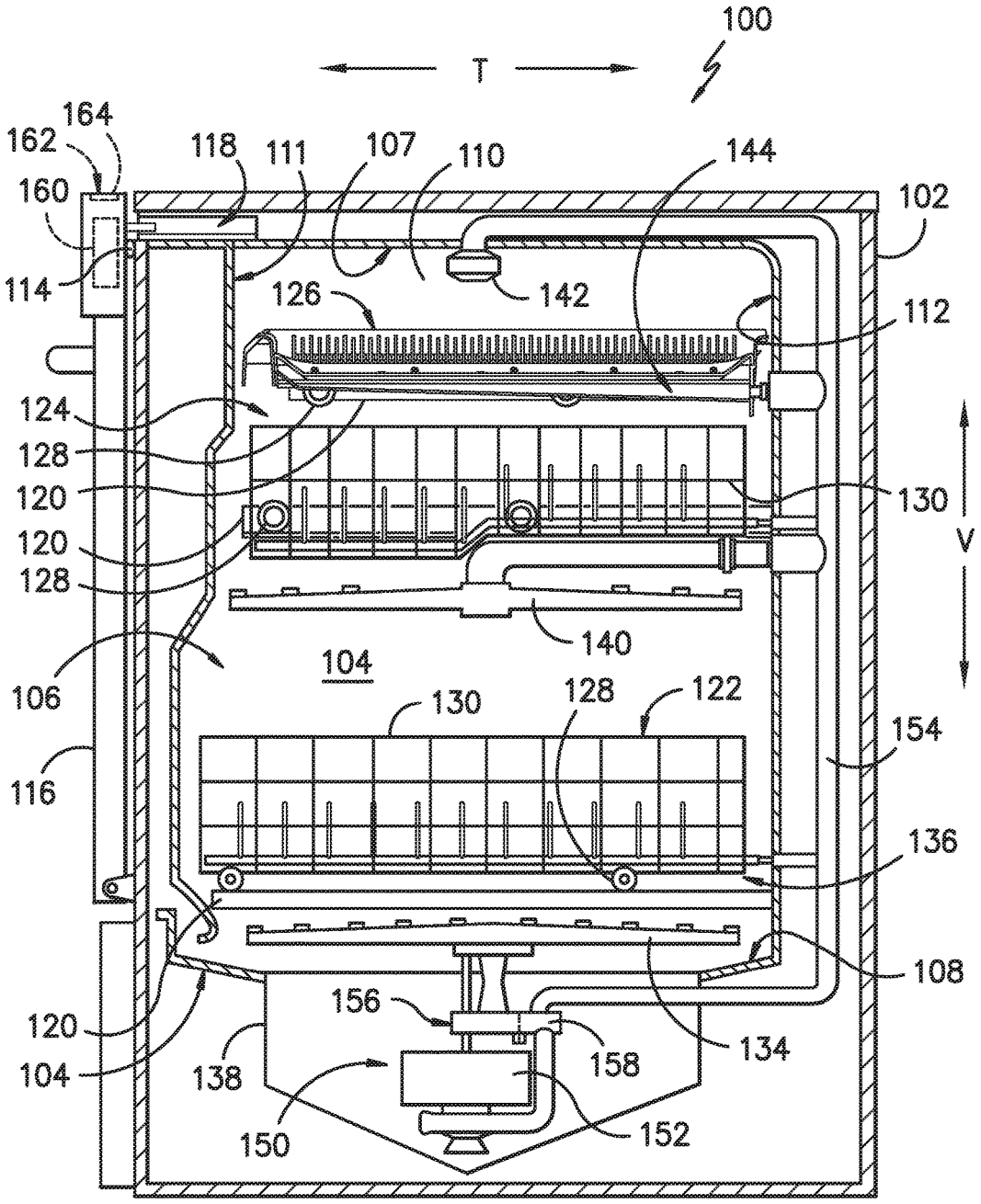
FIG. 2 provides a side, cross sectional view of the exemplary dishwashing appliance of FIG. 1.
Figure 3:
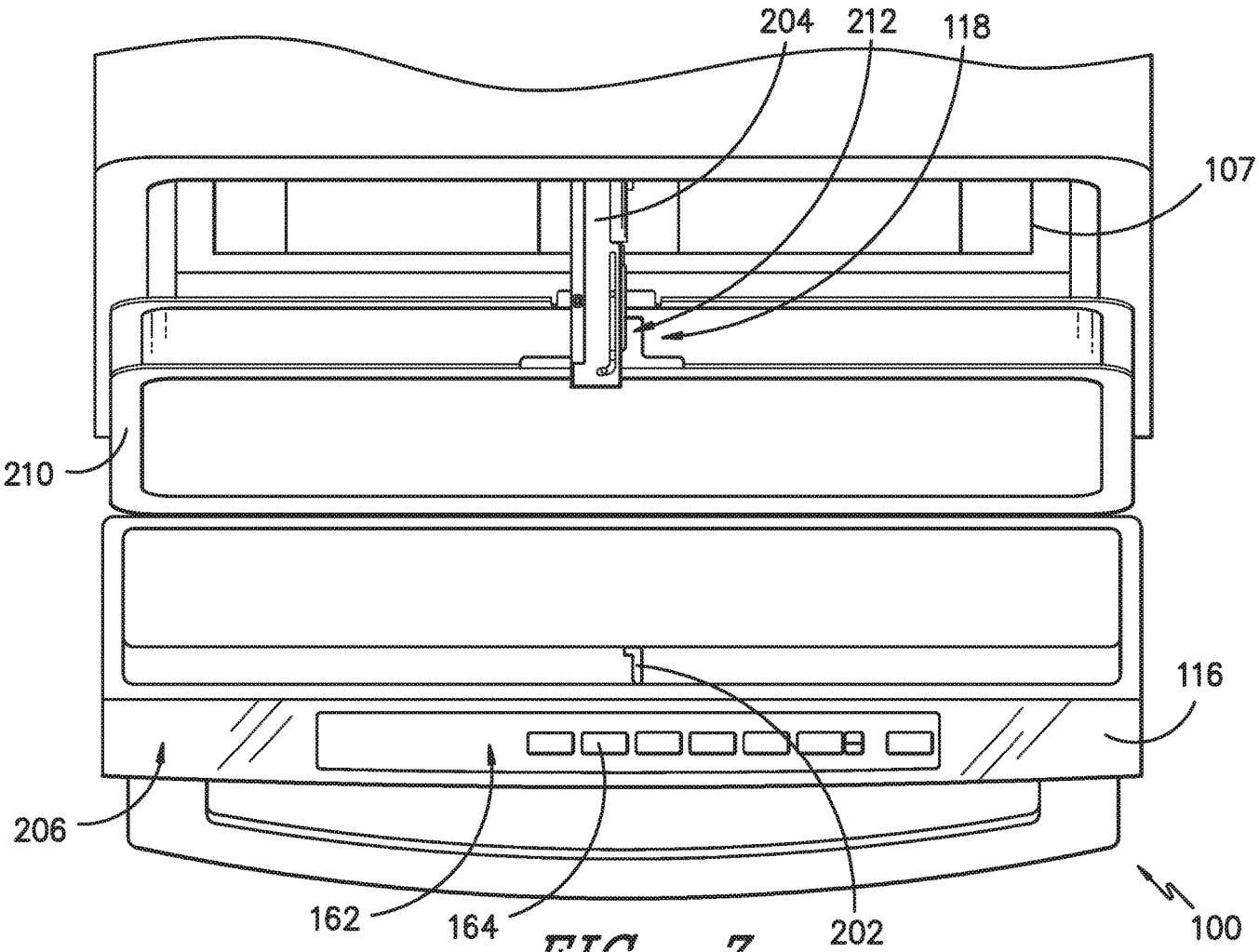
FIG. 3 provides a top, perspective view of the exemplary dishwashing appliance of FIG. 1, illustrating the door in the partially open position according to an example embodiment of the present subject matter.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. As described in more detail below, dishwasher 100 includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, i.e., such as primary supply conduit 154.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Referring now generally to FIGS. 3 through 9, a door closure assembly 118 will be described according to an exemplary embodiment of the present subject matter. According to the illustrated embodiment, door closure assembly 118 is positioned on top of tub 104 and is configured to slowly receive and latch door 116 in the closed position as it pivots toward the closed position. However, it should be appreciated that aspects of the present subject matter may be used to close and latch any other suitable door on any other suitable appliance. For example, door closure assembly 118 may be used to slowly close a sliding drawer of an appliance, a door that pivots along another axis such as a door of a clothes washing machine, a door of a refrigerator appliance, or a door of any other suitable appliance.

According to the illustrated embodiment, door closure assembly 118 generally includes a striker 202 mounted to door 116 and a latch assembly 204 mounted to tub 104. More specifically, striker 202 is mounted proximate a top 206 of door 116 along the vertical direction V (when door 116 is closed) and a center of door 116 along the lateral direction L. Similarly, latch assembly 204 is mounted on top 107 of tub 104 along the vertical direction V, proximate a center of tub 104 along the lateral direction L, and proximate front 111 along the transverse direction T. In addition, as best illustrated in FIG. 2, latch assembly 204 is positioned between tub 104 and cabinet 102.

As door 116 is moved toward the closed position (FIG. 2), striker 202 engages latch assembly 204 which initiates a "slow-close" operation of door 116, as described in detail below. In this regard, for example, cabinet 102 and/or tub 104 can include a front fascia 210 that defines an aperture 212 for receiving striker 202 when door 116 is moved toward the closed position. Thus, latch assembly 204 is at least partially hidden behind front fascia 210 for an improved appearance. In addition, front fascia 210 may serve at least in part as a sealing surface upon which a gasket 214 (FIG. 2) is compressed to form a fluid seal between tub 104 and door 116. It should be appreciated that according to alternative embodiments, the position, orientation, and configuration of striker 202 and latch assembly 204 may vary while remaining within the scope of the present subject matter.

Referring still generally to FIGS. 3 through 9, latch assembly 204 generally includes a latch body 220 that is mounted to tub 104 using one or more mechanical fasteners 222, such as screws, bolts, rivets, etc. Alternatively, glue, welding, snap-fit mechanisms, interference-fit mechanisms, or any suitable combination thereof may secure latch body 220 to tub 104. In addition, latch assembly 204 includes a slide member 224 that is slidably and rotatably positioned within or attached to latch body 220. As described below, slide member 224 is generally sized, positioned and oriented to contact striker 202 and implement the slow-close action.

More specifically, as best illustrated in FIGS. 5 through 9, latch body 220 defines a guide chamber 230 (FIG. 7) that extends along a plane parallel to top 107 of tub 104 (e.g., extending along the lateral direction L and the transverse direction T). Slide member 224 is positioned within guide chamber 230 such that it may slide and rotate within guide chamber 230. For example, according to the illustrated embodiment, latch body 220 may further define a guide slot 232 and slide member 224 may define a first guide element (e.g., first pin 234) and a second guide element (e.g., second pin 236) that are received within guide slot 232 for slidably coupling slide member 224 to latch body 220. It should be appreciated that pins 234, 236 may be integrally formed with slide member 224 and may be any suitable size or shape.

Notably, the geometry of guide slot 232 and the positioning of pins 234, 236 on slide member 224 can affect the closing motion of door 116. For example, according to the illustrated embodiment, guide slot 232 is substantially L-shaped and includes a long segment 240 and a short segment 242. As explained in more detail below, the geometry of guide slot 232 and the position of pins 234, 236 are selected such that slide member 224 is latched in an extended position (FIGS. 3, 5, 7, 8) when first pin 234 is positioned in short segment 242 and slide member 224 is movable toward the retracted position (FIGS. 4 and 6) when first pin 234 is positioned in long segment 240.

Figure 4:
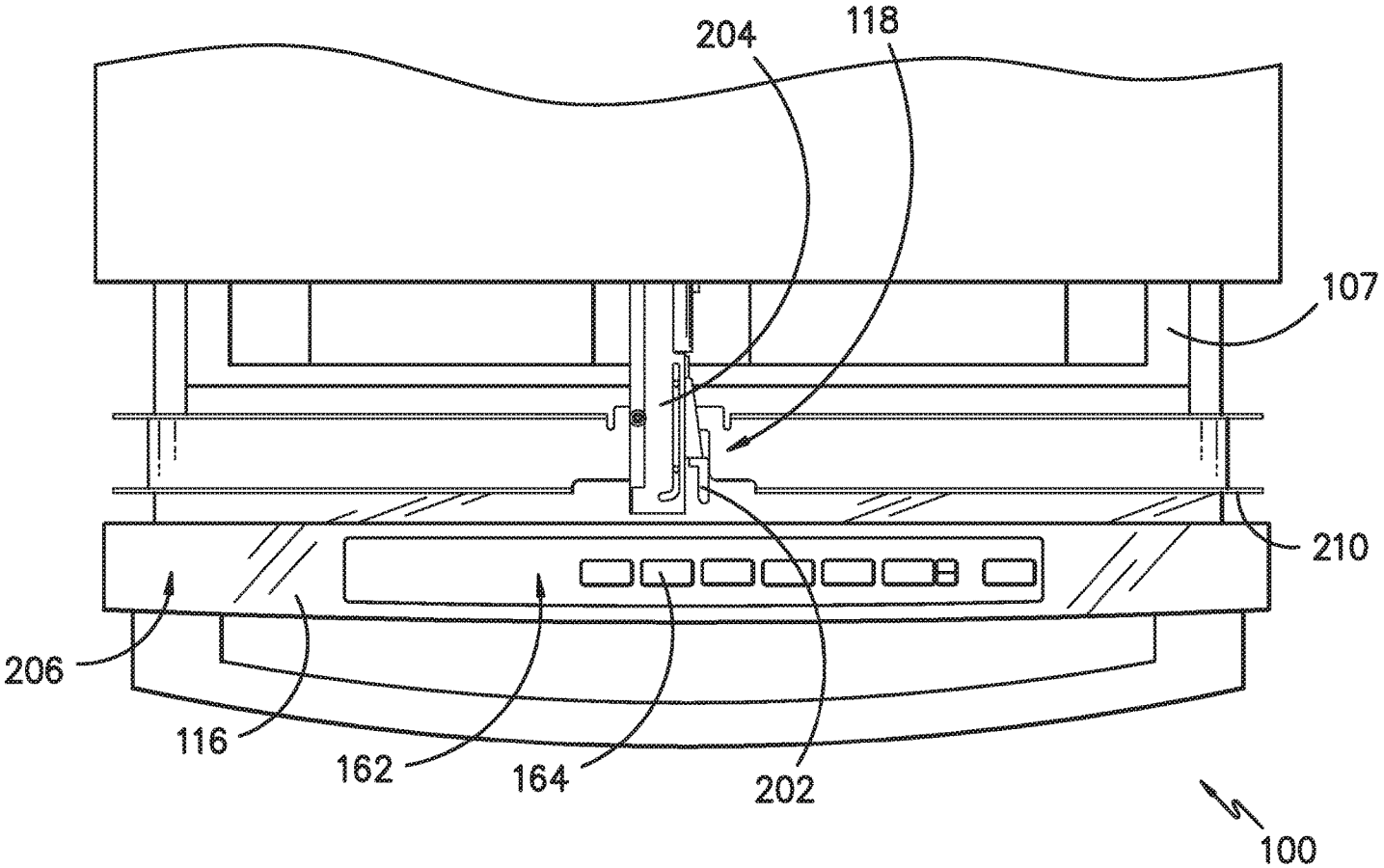
FIG. 4 provides a top, perspective view of the exemplary dishwashing appliance of FIG. 1, illustrating the door in a closed position according to an example embodiment of the present subject matter.
Figure 6:
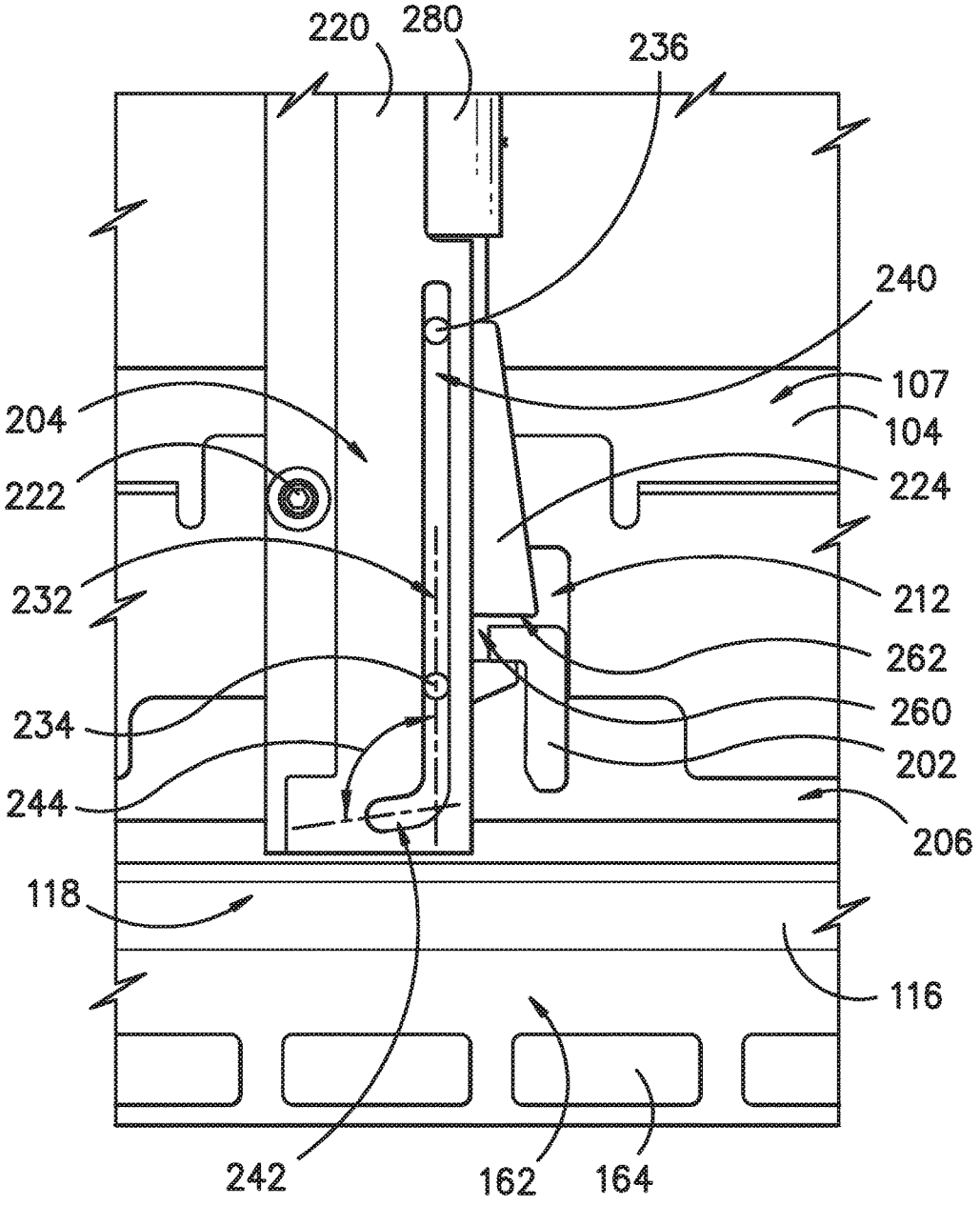
FIG. 6 provides a close-up, perspective view of the exemplary door closure assembly of FIG. 5 after the door has reached the closed position.

More specifically, according to the illustrated embodiment, long segment 240 extends substantially along the transverse direction T and short segment 242 extends at an angle relative to the long segment 240. More specifically, a slot angle 244 is defined between long segment 240 and short segment 242 of guide slot 232 that is, for example, between about 95° and 120°. For example, according to one exemplary embodiment, slot angle 244 is approximately 110°. Slot angle 244 is generally selected to orient short segment 242 in a manner that allows first pin 234 to become seated or latched within short segment 242 to prevent slide member 224 from moving toward the retracted position (e.g., as shown in FIGS. 4 and 6 and corresponding to door 116 being in the closed position).

Figure 8:
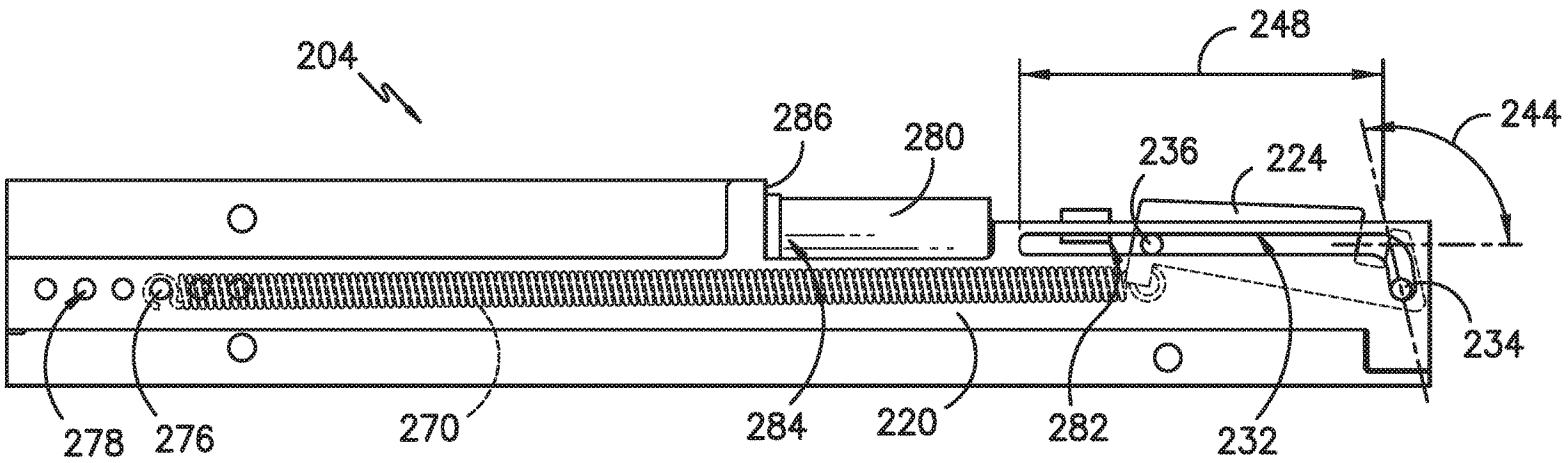
FIG. 8 provides a top view of the exemplary latch assembly of FIG. 7 with a slide member in the latched position.
Figure 9:
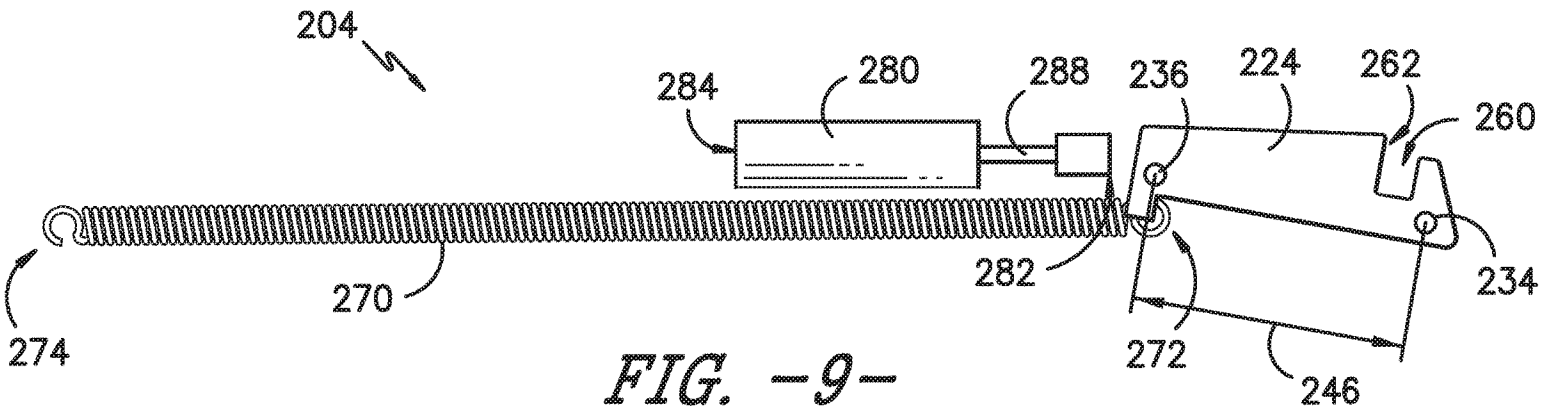
FIG. 9 provides a top view of the exemplary latch assembly of FIG. 7 with a latch body hidden to illustrate various components of the exemplary latch assembly.

In addition, first pin 234 and second pin 236 may be offset relative to each other on slide member 224 and may be separated by a pin distance 246 (see, e.g., FIG. 9). According to an exemplary embodiment, pin distance 246 is greater than half of a length 248 (see, e.g., FIG. 8) defined by long segment 240 of guide slot 232. For example, according to the illustrated embodiment, pin distance 246 is about 60% of length 248, though this value may vary according to alternative embodiments. It should be appreciated that the pin distance 246 and distance 248 may be varied to control the interaction between slide member 224 and guide slot 232.

Figure 5:
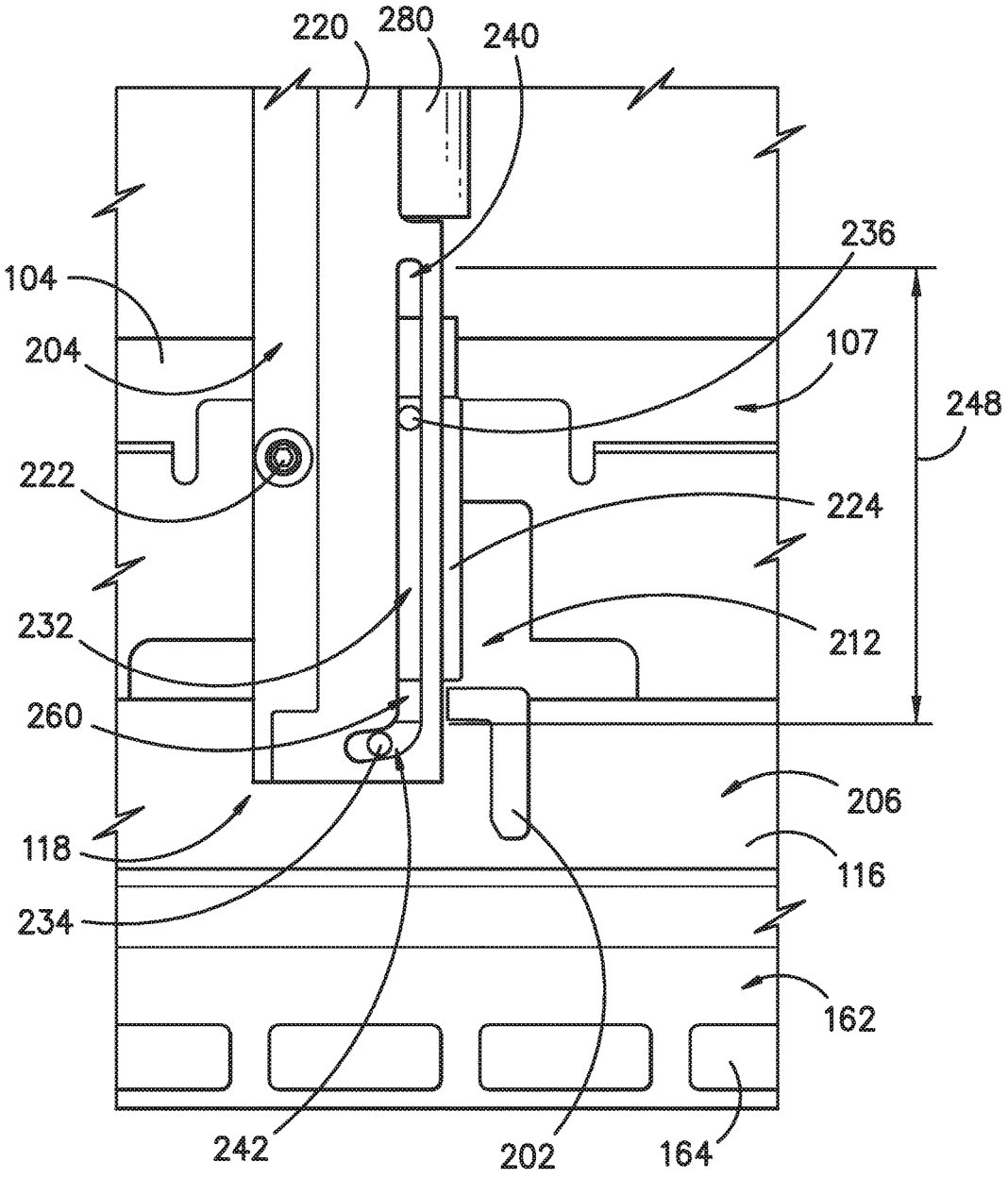
FIG. 5 provides a close-up, perspective view of a door closure assembly that may be used with the exemplary dishwashing appliance of FIG. 1 according to an exemplary embodiment of the present subject matter, wherein a striker is about to engage the door closure assembly.

As best illustrated in FIG. 9, slide member 224 further defines a striker slot 260 for receiving striker 202 as door 116 is moved toward the closed position. In this regard, slide member 224 defines a contact surface 262 that at least partially defines striker slot 260 and that protrudes from latch body 220. Contact surface 262 is aligned with striker 202 along the transverse direction T such that striker 202 engages contact surface 262 as door 116 is moved toward the closed position. In this manner, when striker 202 engages contact surface 262 (e.g., as shown in FIG. 5), slide member 224 rotates such that first pin 234 is rotated into long segment 240 of guide slot 232, thereby unlatching slide member 224 and allowing it to move along the transverse direction T.

Figure 7:
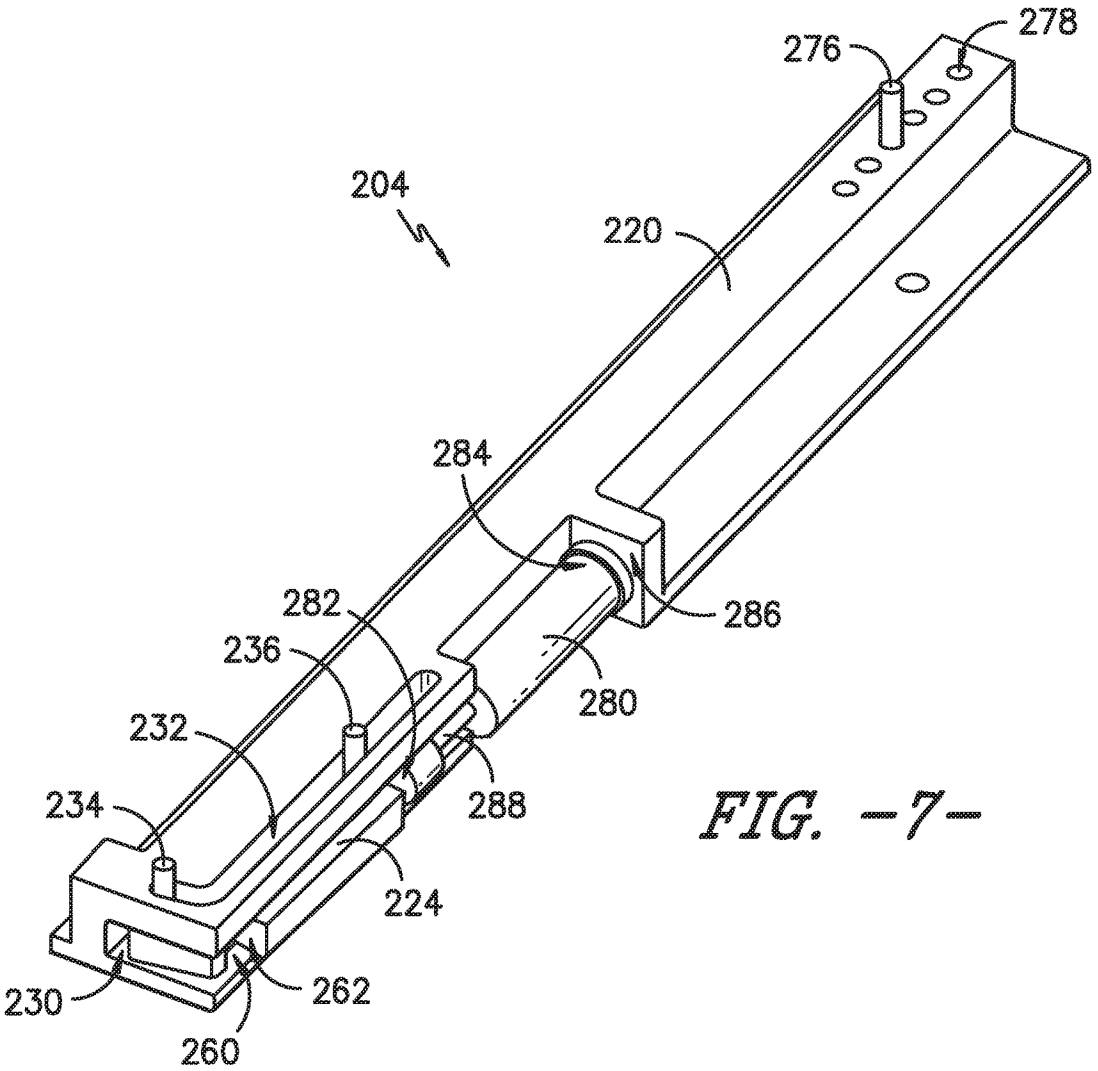
FIG. 7 provides a perspective view of a latch assembly of the exemplary door closure assembly of FIG. 5 according to an exemplary embodiment of the present subject matter.

Referring now generally to FIGS. 7 through 9, after slide member 224 is positioned in the unlatched position, a spring element 270 is configured for urging slide member 224 toward the retracted position and door 116 to the closed position. More specifically, spring element 270 includes a first end 272 attached to slide member 224 and a second end 274 that is fixed relative to latch body 220. More specifically, spring element 270 is fixed to latch body 220 by a spring pin 276. As illustrated in FIGS. 7 and 8, spring pin 276 is configured for receipt within one of a plurality of apertures 278 defined through latch body 220. Spring pin 276 passes through or is otherwise attached to second end 274 of spring element 270 to fix second end 274 relative to latch body 220. In this manner, the tension in spring element 270 may be adjusted by moving spring pin 276 between apertures 278. For example, according to an exemplary embodiment, the position of spring pin 276 may be selected such that the tension in spring element 270 is sufficient to compress gasket 214 by a predetermined amount, e.g., to ensure a proper fluid seal between tub 104 and door 116. In addition, or alternatively, spring element 270 may be interchangeable with any suitable mechanical spring mechanism having a desired spring constant.

Door closure assembly 118 further includes a damping element 280 that is operably coupled to slide member 224 for damping the movement of slide member 224 as it moves toward the retracted position. More specifically, damping element 280 includes a first end 282 configured for engaging slide member 224 and a second end 284 that is fixed relative to latch body 220. More specifically, second end 284 of damping element 280 is fixed to a support flange 286 defined by latch body 220 and includes a damping rod 288 that extends toward sliding member 224. As sliding member 224 moves toward the retracted position, damping element 280 engages slide member 224 (e.g., via damping rod 288) and acts to slow the movement of slide member 224 toward the retracted position. Although a gap is illustrated between first end 282 of damping element 280 and slide member 224, it should be appreciated that according to alternative embodiments, damping element 280 may be coupled to slide member 224 such that there is no lag between when slide member 224 begins to move toward the retracted position and when damping element 280 begins to resist that motion.

Any suitable, type, number, and configuration of damping element 280 may be selected depending on the application. For example, the stiffness of damping element 280 may be selected such that the velocity of slide member 224 does not exceed a predetermined value. In this manner, spring element 270 and a damper element 280 act collectively to slowly move slide member 224 to the retracted position and door 116 to the closed position. More specifically, during operation, as door 116 is moved toward the closed position, striker 202 engages contact surface 262 and is received in striker slot 260, thereby rotating slide member 224 into the unlatched position (e.g., first pin 234 is located within long segment 240). The momentum of door 116 and the force of spring element 270 draw slide member 224 into the retracted position (and door 116 into the closed position), while damping element 280 counteracts the closing momentum to achieve the slow-close operation. By contrast, when door 116 is pulled toward the open position, striker 202 pulls on slide member 224 (e.g., via engagement with striker slot 260), spring element 270 is extended, and slide member 224 is rotated into the latched position before striker 202 and door 116 disengages striker slot 260.

It should be appreciated that door closure assembly 118 is used only for the purpose of explaining aspects of the present subject matter. Modifications and variations may be made to door closure assembly 118 while remaining within the scope of the present subject matter. For example, the size, configuration, position, and operation of striker 202 and/or latch assembly 204 may vary, the geometry of guide slot 232 and the positioning of pins 234, 236 may be adjusted to control their interaction and the resulting closing motion of door 116, and the spring tension and damper resistance may be adjusted while remaining within the scope of the present subject matter.

Door closure assembly 118 as described above provides a simple and effective mechanism for ensuring door 116 of dishwasher appliance 100 is closed slowly to prevent slamming, loud noises, and potential wear on one or more components of door closure assembly 118 or dishwasher appliance 100. In addition, latch assembly 204 may be adjusted to meet the needs of any particular application. For example, the configuration of guide slot 232 and pins 234, 236 may be adjusted, the spring tension may be adjusted to ensure proper gasket compression, and other adjustments may be implemented as well. Thus, door closure assembly 118 provides a versatile and effective means for slowly and completely closing door 116 in a manner that improves dishwasher appliance 100 operation and consumer satisfaction. Other configurations and benefits will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance defining a vertical, a lateral, and a transverse direction, the dishwasher appliance comprising:

a cabinet;

a tub positioned within the cabinet, the tub defining a wash chamber for receipt of articles for washing;

a door rotatably mounted to the cabinet and being movable between an open position and a closed position; and a damped closure assembly comprising:

a striker mounted to the door;

a latch body attached to the tub and defining a guide slot;

a slide member defining a first guide element and a second guide element that are received within the guide slot for slidably coupling the slide member to the latch body;

a spring element attached to the slide member for urging the slide member toward a retracted position; and a damping element operably coupled to the slide member for damping the movement of the slide member toward the retracted position.

2. The dishwasher appliance of claim 1, wherein the slide member further defines a striker slot for receiving the striker as the door is moved toward the closed position.

3. The dishwasher appliance of claim 1, wherein the slide member defines a contact surface that protrudes from the latch body, the contact surface being aligned with the striker along the transverse direction such that the striker engages the contact surface as the door is moved toward the closed position.

4. The dishwasher appliance of claim 1, wherein the guide slot is substantially L-shaped and includes a long segment and a short segment, and wherein the slide member is latched in an extended position when the first guide element is positioned in the short segment and the slide member is movable toward the retracted position when the first guide element is positioned in the long segment.

5. The dishwasher appliance of claim 4, wherein the slide member rotates when the striker engages the slide member such that the first guide element is rotated into the long segment of the guide slot.

6. The dishwasher appliance of claim 4, wherein a slot angle is defined between the long segment of the guide slot and the short segment of the guide slot, the angle being between about 95° and 120°.

7. The dishwasher appliance of claim 6, wherein the slot angle is about 110°.

8. The dishwasher appliance of claim 4, wherein the first guide element is a first pin and the second guide element is a second pin, the first pin and the second pin being separated by a pin distance, the pin distance being greater than half of a length of the long segment of the guide slot.

9. The dishwasher appliance of claim 8, wherein the pin distance is about 60% of the length of the long segment of the guide slot.

10. The dishwasher appliance of claim 1, wherein the dishwasher appliance further comprises a gasket positioned between the tub and the door for providing a fluid seal when the door is in the closed position, and wherein the spring element is selected such that a tension value of the spring element is sufficient to compress the gasket by a predetermined amount.

11. The dishwasher appliance of claim 1, wherein the damped closure assembly further comprises a spring pin configured for receipt within one of a plurality of apertures defined through the latch body, the spring element extending between the slide member and the spring pin such that the tension in the spring element may be adjusted by moving the spring pin between the plurality of apertures.

12. The dishwasher appliance of claim 1, wherein the latch body defines a guide chamber that extends along a plane parallel to a top of the tub, the slide member being positioned within the guide chamber.

13. The dishwasher appliance of claim 1, wherein the latch body is positioned between the tub and the cabinet at a top of the tub along the vertical direction and a center of the tub along the lateral direction.

14. The dishwasher appliance of claim 1, wherein the latch body is positioned behind a front fascia of the cabinet, the front fascia defining an aperture for receiving the striker when the door is moved toward the closed position.

15. A damped closure assembly for a door of a dishwasher appliance, the dishwasher appliance comprising a cabinet and a tub positioned within the cabinet and defining a wash chamber for receipt of articles for washing, the damped closure assembly comprising:

a striker mounted to the door;

a latch body attached to the tub and defining a guide slot;

a slide member defining a first guide element and a second guide element that are received within the guide slot for slidably coupling the slide member to the latch body;

a spring element attached to the slide member for urging the slide member toward a retracted position; and a damping element operably coupled to the slide member for damping the movement of the slide member toward the retracted position.

16. The damped closure assembly of claim 15, wherein the slide member further defines:

a striker slot for receiving the striker as the door is moved toward the closed position; and a contact surface that protrudes from the latch body, the contact surface being aligned with the striker along the transverse direction such that the striker engages the contact surface as the door is moved toward the closed position.

17. The damped closure assembly of claim 15, wherein the guide slot is substantially L-shaped and includes a long segment and a short segment, and wherein the slide member is latched in an extended position when the first guide element is positioned in the short segment and the slide member is movable toward the retracted position when the first guide element is positioned in the long segment, wherein the slide member rotates when the striker engages the slide member such that the first guide element is rotated into the long segment of the guide slot.

18. The damped closure assembly of claim 17, wherein a slot angle is defined between the long segment of the guide slot and the short segment of the guide slot, the angle being between about 95° and 120°.

19. The damped closure assembly of claim 17, wherein the first guide element is a first pin and the second guide element is a second pin, the first pin and the second pin being separated by a pin distance, the pin distance being greater than half of a length of the long segment of the guide slot.

20. The damped closure assembly of claim 15, wherein the damped closure assembly further comprises a spring pin configured for receipt within one of a plurality of apertures defined through the latch body, the spring element extending between the slide member and the spring pin such that the tension in the spring element may be adjusted by moving the spring pin between the plurality of apertures.

* * * * *